US008272338B2

(12) United States Patent
Chow

(10) Patent No.: US 8,272,338 B2
(45) Date of Patent: Sep. 25, 2012

(54) SAFE ANCHORING DEVICE

(76) Inventor: Leslie Ho Leung Chow, Shilouzhen (CN)

( * ) Notice: Subject to any disclaimer, the term of this patent is extended or adjusted under 35 U.S.C. 154(b) by 261 days.

(21) Appl. No.: 12/568,509

(22) Filed: Sep. 28, 2009

(65) Prior Publication Data

US 2011/0073019 A1 Mar. 31, 2011

(51) Int. Cl.
*E05G 1/00* (2006.01)
*E06B 7/16* (2006.01)

(52) U.S. Cl. ..... 109/51; 52/364; 70/232; 70/DIG. 57; 109/75; 109/80; 109/84; 220/378; 312/351.1

(58) Field of Classification Search ..... 70/232, 70/DIG. 57; 109/50–52, 75, 76, 80–85; 220/378; 248/548, 551–553, 678; 312/351.1, 400, 312/409; 52/27, 143, 364
See application file for complete search history.

(56) References Cited

U.S. PATENT DOCUMENTS

| | | | | | |
|---|---|---|---|---|---|
| 101,770 | A | * | 4/1870 | Schreyer | 109/22 |
| 165,599 | A | * | 7/1875 | Macneale | 109/75 |
| 209,181 | A | * | 10/1878 | Miller | 292/307 B |
| 595,128 | A | * | 12/1897 | Mcarthur | 49/318 |
| 936,527 | A | * | 10/1909 | Fisher | 232/39 |
| 937,215 | A | * | 10/1909 | Kelonge | 109/51 |
| 1,837,501 | A | * | 12/1931 | Sunnes | 70/418 |
| 1,959,291 | A | * | 5/1934 | Millice | 109/51 |
| 1,970,178 | A | * | 8/1934 | Michlun | 248/154 |
| 2,139,909 | A | * | 12/1938 | Park | 109/47 |
| 3,587,486 | A | * | 6/1971 | Heinrichs | 109/51 |
| 3,667,405 | A | * | 6/1972 | Roach, Jr. | 109/51 |
| 3,724,798 | A | * | 4/1973 | Lucasey | 248/418 |
| 4,078,697 | A | * | 3/1978 | Schlosberg et al. | 220/378 |
| 4,108,087 | A | * | 8/1978 | Sebesta | 109/51 |
| 4,144,682 | A | * | 3/1979 | Cousin | 52/103 |
| 4,193,353 | A | * | 3/1980 | Hinton et al. | 109/50 |
| 4,339,629 | A | * | 7/1982 | Stanmore | 174/50 |
| 4,393,655 | A | * | 7/1983 | Komorizono | 60/585 |
| 4,408,546 | A | * | 10/1983 | Schmidt | 109/75 |
| 4,492,430 | A | * | 1/1985 | Morris et al. | 359/883 |
| 4,579,248 | A | * | 4/1986 | Gorges | 220/327 |
| 4,638,604 | A | * | 1/1987 | Rogers et al. | 52/6 |
| 4,716,810 | A | * | 1/1988 | DeGuvera | 89/36.02 |
| 4,726,206 | A | * | 2/1988 | Hsu | 70/441 |
| 4,747,601 | A | * | 5/1988 | Glachet | 277/628 |

(Continued)

*Primary Examiner* — Lloyd Gall
(74) *Attorney, Agent, or Firm* — John R. Ross; John R. Ross, III

(57) ABSTRACT

A safe anchoring device for anchoring a safe to a floor. In addition to anchoring the safe, the safe anchoring device simultaneously provides a watertight and airtight seal for the interior of the safe. A tunnel connects the interior housing to the exterior housing. Insulation is between the interior housing and the exterior housing. A removable top cover covers the tunnel on the inside of the safe at the interior housing. When the anchoring device is used to anchor the safe to the floor, a removable threaded locking bolt extends through the tunnel and is threaded onto a threaded tube section of a bottom cover while the bottom cover is securely attached to the floor. In a preferred embodiment, when the safe is anchored to the floor the watertight and airtight seal is provided by a gasket under the top cover and an O-ring under the bolt head of the threaded locking bolt. When the safe is not anchored to the floor, the threaded locking bolt is removed and the bottom cover covers the tunnel at the exterior housing. In a preferred embodiment, when the safe is not anchored to the floor the watertight and airtight seal is provided by gaskets under the top cover and the bottom cover.

8 Claims, 6 Drawing Sheets

U.S. PATENT DOCUMENTS 4,830,316 A * 5/1989 Nehl ..... 248/27.1
4,884,420 A * 12/1989 Finkel et al. ..... 70/58
4,887,787 A * 12/1989 Friedrichs ..... 248/551
4,926,762 A * 5/1990 Paul ..... 109/51
5,176,437 A * 1/1993 Remington ..... 312/351.1
5,190,182 A * 3/1993 Copas et al. ..... 220/262
5,235,920 A * 8/1993 Hector ..... 109/51
5,279,436 A * 1/1994 Elliott et al. ..... 220/1.5
5,335,892 A * 8/1994 Busch ..... 248/551
5,377,602 A * 1/1995 Keogh ..... 109/51
5,381,618 A * 1/1995 Singleton ..... 40/202
5,677,850 A * 10/1997 Ott ..... 702/42
5,692,721 A * 12/1997 Roberts ..... 248/551
5,709,110 A * 1/1998 Greenfield et al. ..... 70/58
5,709,367 A * 1/1998 Heintz et al. ..... 248/551
5,794,463 A * 8/1998 McDaid ..... 70/18
5,794,465 A * 8/1998 Hill ..... 70/63
5,806,354 A * 9/1998 Hasnik ..... 70/237
6,684,548 B1 * 2/2004 Petrus ..... 42/70.11
7,545,639 B2 * 6/2009 Ridge ..... 361/690
2003/0205014 A1 * 11/2003 Schneider ..... 52/364

* cited by examiner

SAFE ANCHORING DEVICE

The present invention relates to safes, and in particular, to anchoring devices for safes.

BACKGROUND OF THE INVENTION

Currently, safes are mainly used for the storage of valuables such as jewelry. However, as society progresses and as the economy expands, bank books, cash, identification and other important documents also need to be stored. Additionally, as computer technology develops, computer media records including hard drives and diskettes need to be stored appropriately.

Thieves, if they are unable to break into a safe at its location, will often try to remove the safe to a different location. To combat this, in the prior art there are safes which are secured to the ground through bolts screwed through the bottom of the safe. However, these prior art anchoring devices are known to have inadequate sealing capabilities.

It is important that a safe always has a proper seal to protect the contents stored inside the safe. When a safe is submerged in water, if the sealing is inadequate, water will go into the safe and destroy the contents within. Moreover, if the sealing is inadequate, contents can also be destroyed by humidity or smoke and heat from a fire. Hence, a safe not only needs good anti-theft properties but also needs be highly sealed which can provide water-proof, anti-humidity and fire proof qualities.

What is needed is a better safe anchoring device.

SUMMARY OF THE INVENTION

The present invention provides a safe anchoring device for anchoring a safe to a floor. In addition to anchoring the safe, the safe anchoring device simultaneously provides a watertight and airtight seal for the interior of the safe. A tunnel connects the interior housing to the exterior housing. Insulation is between the interior housing and the exterior housing. A removable top cover covers the tunnel on the inside of the safe at the interior housing. When the anchoring device is used to anchor the safe, a removable threaded locking bolt extends through the tunnel and is threaded onto a threaded tube section of a bottom cover while the bottom cover is bolted into the floor. In a preferred embodiment, when the safe is anchored to the floor the watertight and airtight seal is provided by a gasket under the top cover and an O-ring under the bolt head of the threaded locking bolt. When the safe is not anchored to the floor, the threaded locking bolt is removed and the bottom cover covers the tunnel at the exterior housing. In a preferred embodiment, when the safe is not anchored to the floor the watertight and airtight seal is provided by gaskets under the top cover and the bottom cover.

DETAILED DESCRIPTION OF A PREFERRED EMBODIMENT

Figure 10:
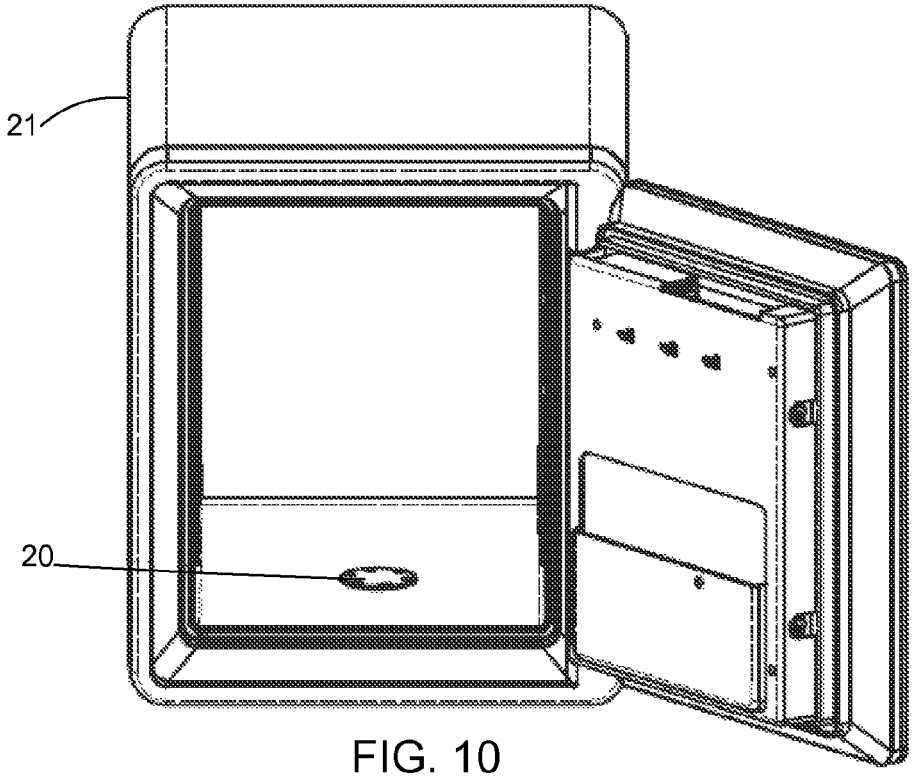
FIG. 10 shows a preferred locking mechanism inside a safe.

FIG. 10 shows a perspective view of a preferred embodiment of the present invention. Locking mechanism 20 is utilized to anchor safe 21 to the floor while at the same time providing airtight and watertight protection for the interior of safe 21.

Figure 1:
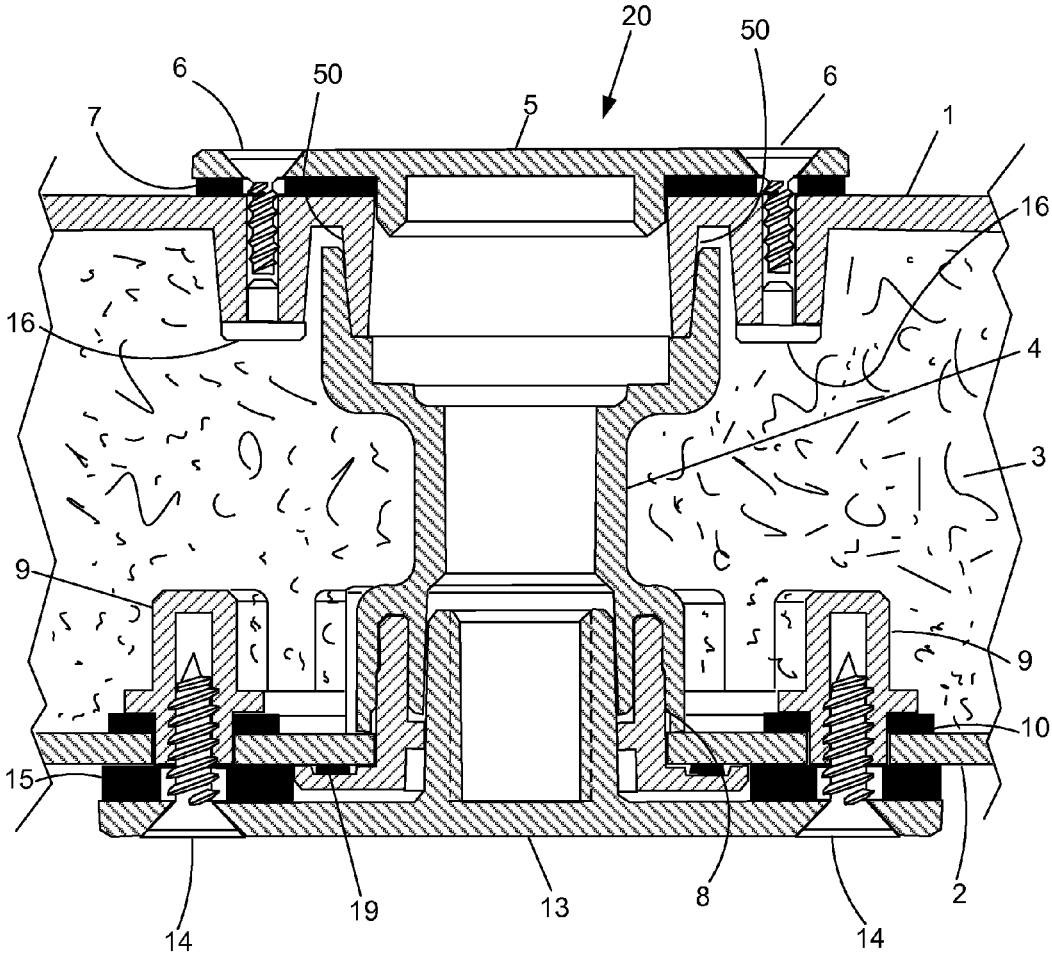
FIG. 1 shows a preferred embodiment of the present invention during safe transport.

FIG. 1 shows a preferred embodiment of the present invention. When configured as shown in FIG. 1, locking mechanism 20 is not being used to secure safe 21 to the floor. However, it is still able to provide watertight and airtight protection for the interior of the safe. For example, FIG. 1 shows the condition of locking mechanism 20 during the time in which it is being shipped to a customer or during a time in which it is being transported from one location to another. In FIG. 1, the interior of safe 21 is protected from water, humidity and smoke by virtue of gaskets 15 and 7.

Figure 6:
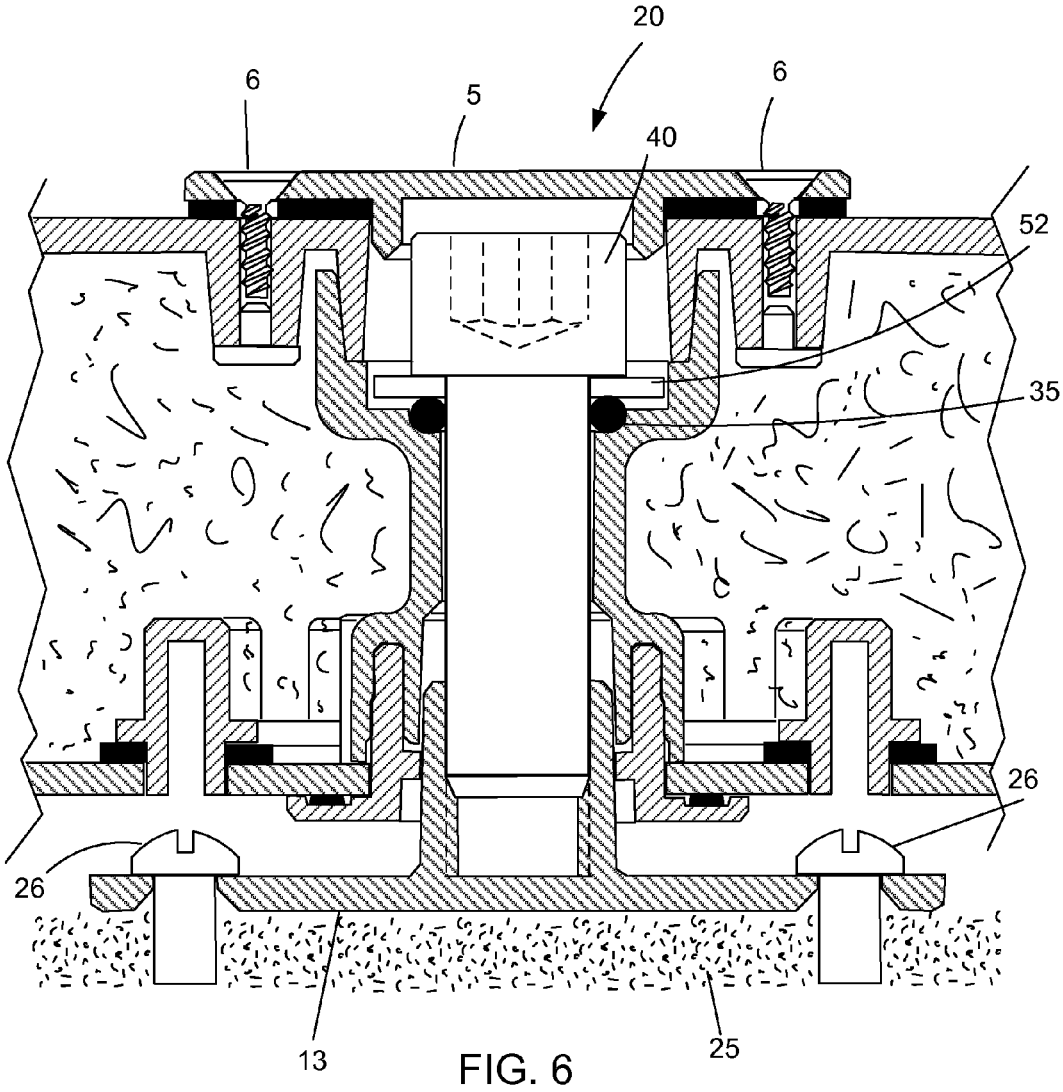
Figure 11:
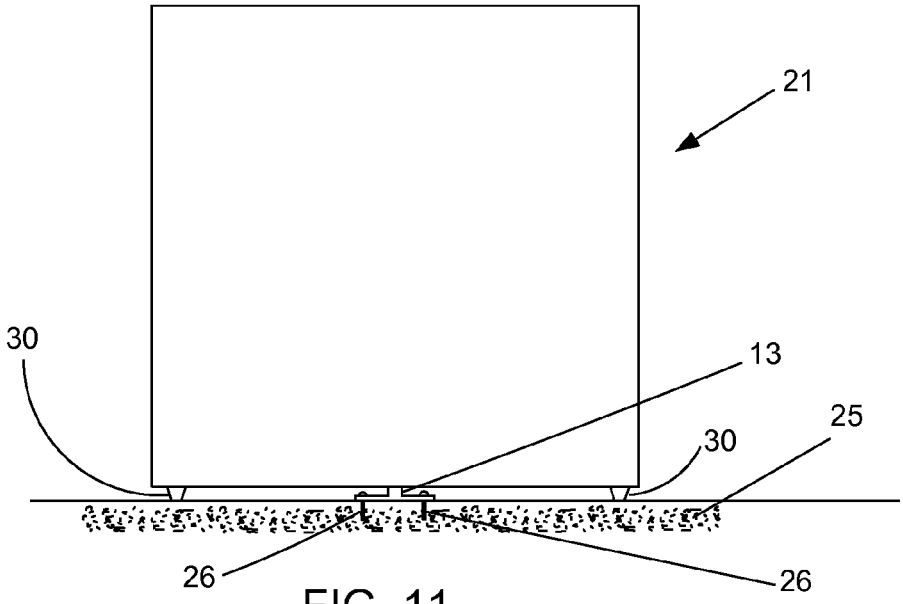
FIG. 11 shows a side view of a safe anchored to the floor.

FIG. 6 shows locking mechanism 20 when safe 21 is locked to a concrete floor. In FIG. 6, bottom cover 13 is screwed to concrete floor 25 with bolts 26. Safe 21 is supported in the vertical position shown in FIG. 6 by feet 30 (FIG. 11). Locking bolt 40 is threaded into bottom cover 13 so that safe 21 is anchored to concrete floor 25. In FIG. 6, the interior of safe 21 is protected from water, humidity and smoke by virtue of gasket 7 and O-ring 35.

In FIG. 6, bottom cover 13 is functioning as an anchor nut element in that it is anchored to the floor and in that its threads receive locking bolt 40. Safe 21 closely covers bottom cover 13 so that it is impossible for a thief to reach bottom cover 13 when the safe is locked and closed. When locking mechanism 20 is in the position shown in FIG. 6, safe 21 cannot be removed from the floor without destroying the floor.

Utilization of a Preferred Embodiment

In a preferred embodiment of the present invention, locking mechanism 20 is in the position shown in FIG. 1 when safe 21 is in route during transportation.

Figure 3:
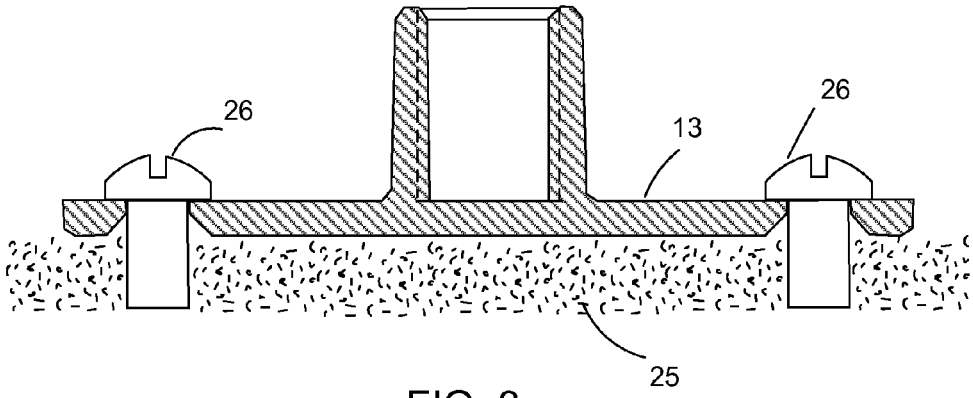
FIGS. 3-6 illustrate a preferred method for anchoring a safe to the floor.

After determining the location for locking the safe to the floor, the user unscrews bottom cover 13 from locking mechanism 20. The user then screws bottom cover 13 to concrete floor 25 using bolts 26 as shown in FIG. 3.

Figure 4:
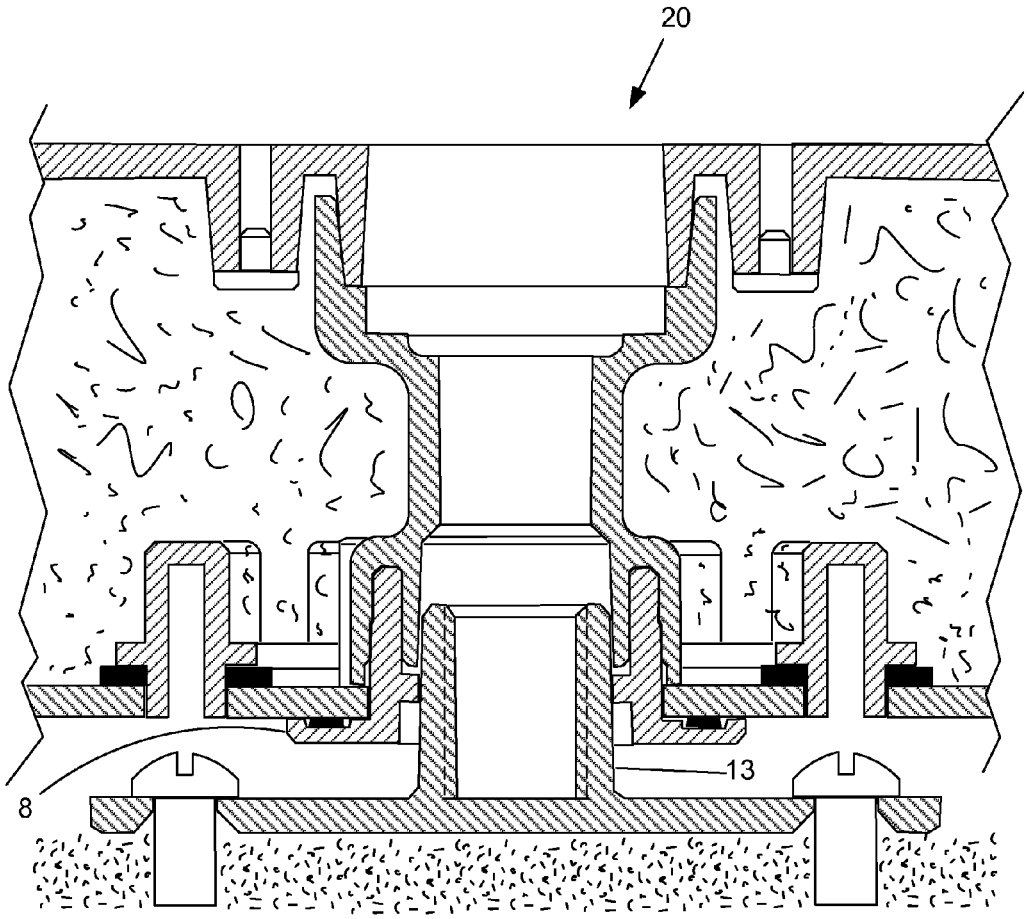

As shown in FIG. 4, the user removes top cover 5 from locking mechanism 20. The user then slides outer tube 8 over bottom cover 13. The weight of the safe is supported by safe feet 30 (FIG. 11).

Figure 5:
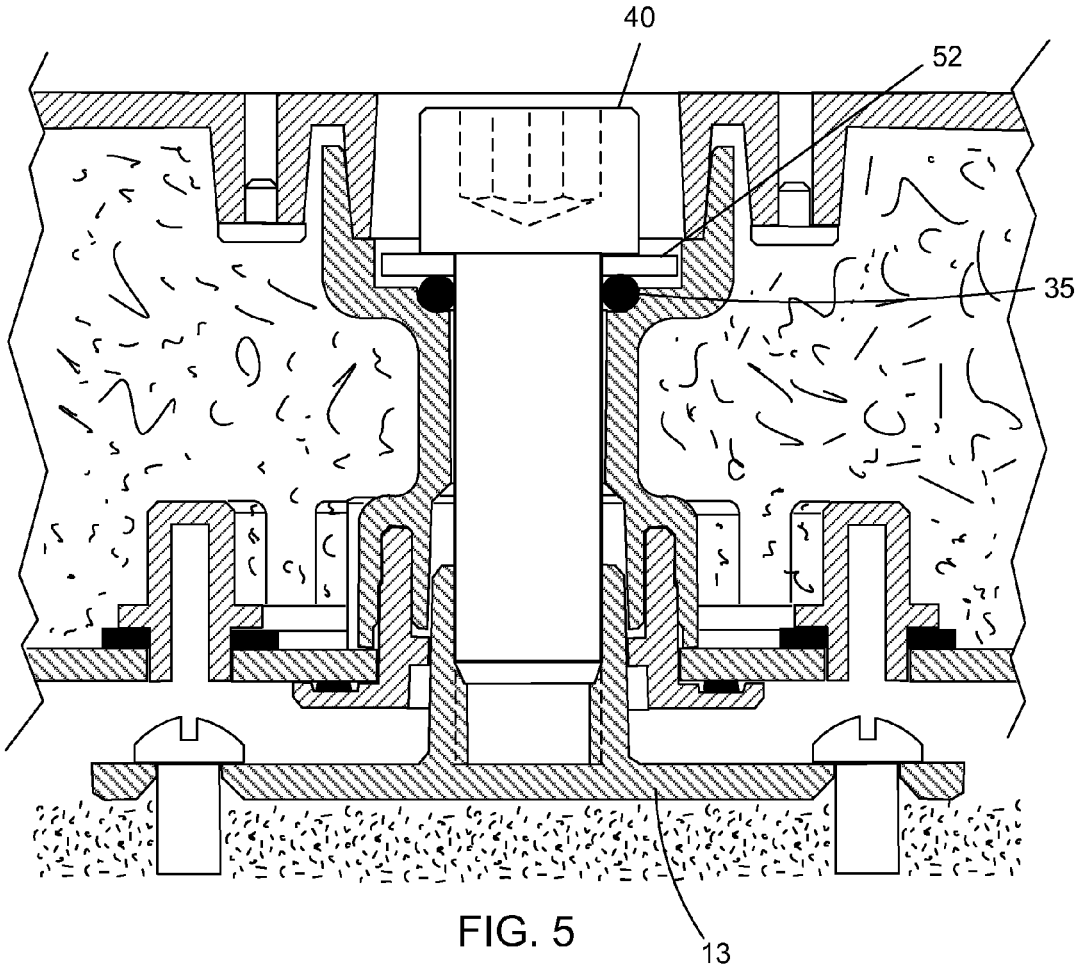

As shown in FIG. 5, locking bolt 40 is inserted through the opening of inner tube 4. Locking bolt 40 is tightly threaded onto bottom cover 13.

As shown in FIG. 6, top cover 5 is tightly reattached to interior housing 1 via screws 6. O-ring 35 and gasket 7 provide watertight and airtight protection for the interior of safe 21. From the position shown in FIG. 6, it is impossible to remove safe 21 from the floor without first destroying the floor.

Preferred Components of the Present Invention

Top Cover

Figure 7:
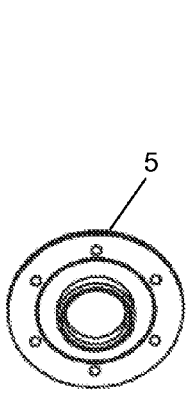
FIG. 7 shows a preferred top cover.

Top cover 5 (shown in FIGS. 1, 2 and 7) is screwed tightly down against the top side of interior housing 1 via self tapping screws 6. Rubber plugs 16 are attached to interior housing 1 as shown and function to provide a seal between insulation 3. Gasket 7 functions to provide a watertight and airtight seal for the protection of the interior of safe 21.

Bottom Cover

Figure 9:
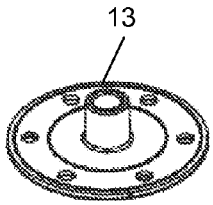
FIG. 9 shows a preferred bottom cover.
Figure 2:
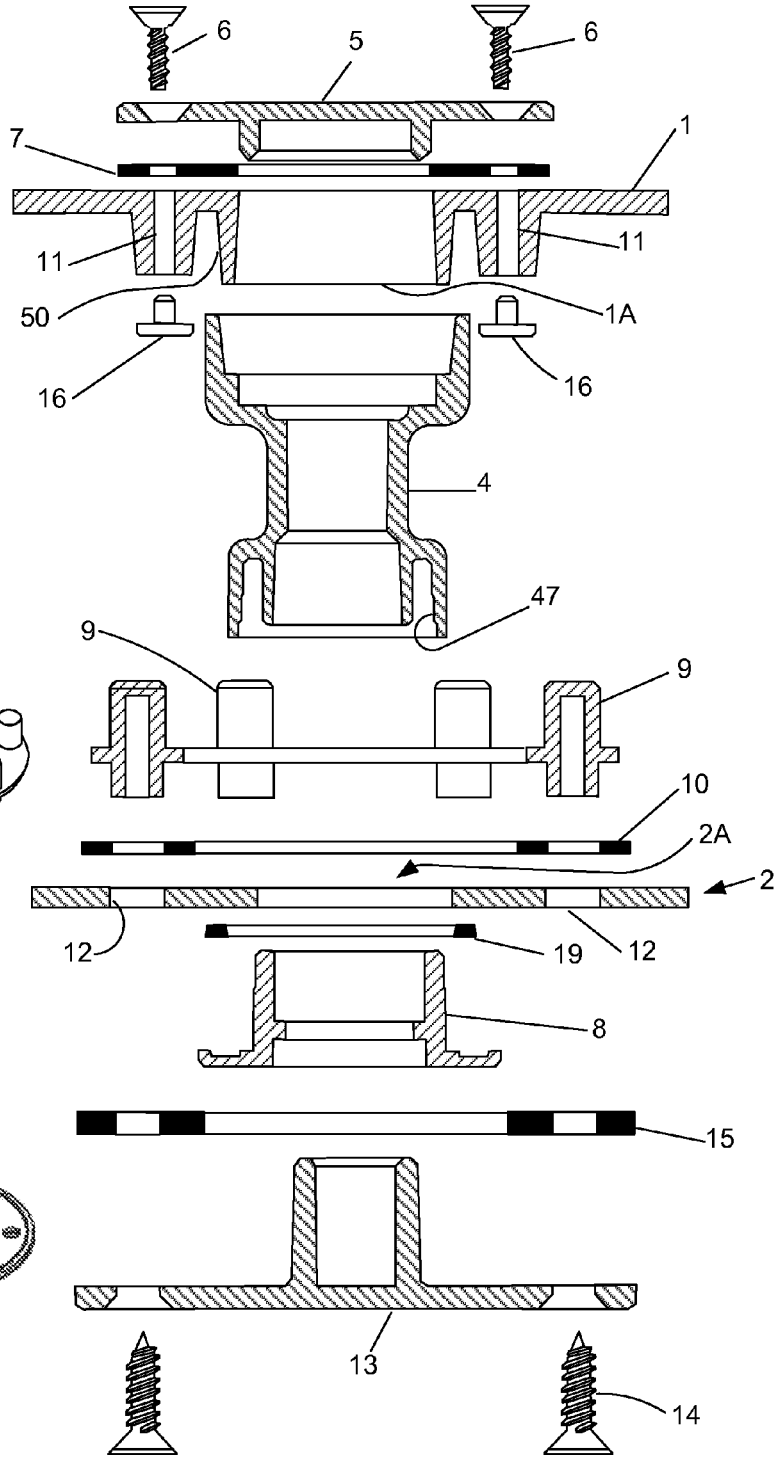
FIG. 2 shows an exploded view of some of the components of a preferred embodiment.

Bottom cover 13 is shown in FIGS. 1, 2 and 9. In FIG. 1 bottom cover 13 is shown in a position during which safe 21 is not locked to a floor (for example, during a transport or delivery of safe 21). Bottom cover 13 is screwed against the bottom of exterior housing 2. Screws are screwed into threads of screw sleeves 9. Gasket 15 functions to provide an airtight and watertight seal for the interior of safe 21. Gasket 10 functions to provide an airtight watertight seal for protection of insulation 3.

When locking mechanism 20 is used to lock safe 21 to the floor, bottom cover 13 is unscrewed from screw sleeves 9 and bolted to the floor. When bottom cover 13 is bolted to the floor, bottom cover 13 is functioning as an anchoring nut element to receive locking bolt 40 (FIG. 6). FIG. 3 shows bottom cover 13 screwed to the floor 25 with bolts 26.

Inner Tube

FIGS. 1 and 4 show inner tube 4. At its top inner tube 4 is spin welded to groove 50 of interior housing 1. At its bottom inner tube 4 is spin welded to outer tube 8.

Outer Tube

Outer Tube 8 is shown in FIGS. 1 and 2. Outer tube 8 is spin welded to groove 47 of inner tube 4 at its top end. At its bottom end outer tube 8 is pressed tight against the bottom side of exterior housing 2. O-ring 19 provides an airtight and water tight seal. Outer tube 8 is spin welded to inner tube 4 to form a tunnel between interior housing 1 and exterior housing 2.

Screw Sleeves

Figure 8:
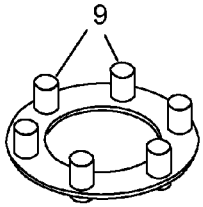
FIG. 8 shows preferred screw sleeves.

Screw Sleeves 9 are shown in FIGS. 1, 2 and 8. Screw sleeves 9 are pressed fit into external housing 2. Gasket 10 provides watertight protection for insulation 3. Screw sleeves 9 include internal threads for receiving screws 14.

Locking Bolt

Locking bolt 40 is shown in FIG. 6. Locking bolt 40 is threaded into threads on bottom cover 13. Washer 52 is under the head of bolt 40 and pressed down on o-ring 35. O-ring 35 provides water tight/air tight protection for the interior of safe 21.

Although the above-preferred embodiments have been described with specificity, persons skilled in this art will recognize that many changes to the specific embodiments disclosed above could be made without departing from the spirit of the invention. For example, although the above description of the preferred embodiments focused on utilizing the present invention to anchor a safe to a floor, the same locking mechanism can be attached to the back wall of the safe and the locking mechanism could be utilized to anchor the safe to a vertical wall. Therefore, the attached claims and their legal equivalents should determine the scope of the invention.

What is claimed is:

1. A safe anchoring system for anchoring a safe to a floor or wall and for providing watertight and airtight seal for the interior of the safe, said safe anchoring system comprising:

A) a safe,

B) a floor or wall,

C) interior housing,

D) exterior housing,

E) insulation between said interior housing and said exterior housing,

F) a tunnel connecting said interior housing to said exterior housing,

G) a removable top cover for covering said tunnel at said interior housing,

H) a removable threaded locking bolt for extending through said tunnel for anchoring said safe to said floor or wall, and I) a bottom cover comprising a threaded tube section for receiving said threaded locking bolt, J) an inner tube rigidly attached to said interior housing, and K) an outer tube rigidly attached to said inner tube and pressed tightly against said exterior housing, wherein said removable threaded locking bolt is adapted to be removed and said bottom cover is adapted to cover said tunnel at said exterior housing when said safe is not rigidly attached to said floor or wall and said locking bolt is adapted to be threaded into said threaded tube section when said bottom cover is rigidly attached to said floor or wall.

2. The safe anchoring system as in claim 1, further comprising a plurality of screw sleeves rigidly connected to said exterior housing wherein said bottom cover is rigidly connected to said exterior housing via screws threaded in said plurality of screw sleeves.

3. The safe anchoring system as in claim 2, further comprising a bottom cover gasket between said bottom cover and said exterior housing, said bottom cover gasket providing said watertight and airtight seal for the interior of the safe.

4. The safe anchoring system as in claim 1, wherein said top cover is rigidly connected to said interior housing via screws threaded into said interior housing.

5. The safe anchoring system as in claim 4 further comprising a top cover gasket between said top cover and said interior housing, said top cover gasket providing said watertight and airtight seal for the interior of the safe.

6. The safe anchoring system as in claim 1, wherein said locking bolt further comprises:

A) a bolt head, and

B) a bolt O-ring under said bolt head, wherein said bottom cover is securely attached to said floor or wall, wherein said tunnel is slid over said threaded tube section, wherein said locking bolt is threaded into said threaded tube section, wherein said bolt O-ring provides said watertight and airtight seal for the interior of the safe.

7. The safe anchoring system as in claim 6, further comprising a top cover gasket between said top cover and said interior housing, wherein said top cover gasket provides said watertight and airtight seal for the interior of the safe.

8. A safe anchoring system for anchoring a safe to a floor or wall and for providing watertight and airtight seal for the interior of the safe, said safe anchoring system comprising:

A) a safe,

B) a floor or wall,

C) interior housing,

D) exterior housing,

E) insulation between said interior housing and said exterior housing,

F) an inner tube rigidly attached to said interior housing,

G) an outer tube rigidly attached to said inner tube and pressed tightly against said exterior housing, H) a removable top cover for covering said inner tube, I) a top cover gasket between said top cover and said interior housing, said top cover gasket providing said watertight and airtight seal for the interior of the safe, J) a removable threaded locking bolt for extending through said inner tube and said outer tube and for anchoring said safe to said floor or wall, K) a bottom cover comprising a threaded tube section for receiving said threaded locking bolt, L) a bottom cover gasket between said bottom cover and said exterior housing, said bottom cover gasket providing said watertight and airtight seal for the interior of the safe, wherein said removable threaded locking bolt is adapted to be removed and said bottom cover is adapted to cover said outer tube when said safe is not anchored to said floor or wall, and said locking bolt is adapted to be threaded into said threaded tube section when said bottom cover is rigidly attached to said floor or wall.

* * * * *